United States Patent [19]

Ciavatta

[11] 4,322,183

[45] Mar. 30, 1982

[54] FRICTION ROCK STABILIZER AND INSTALLATION LUBRICATING CEMENT APPARATUS AND METHOD

[76] Inventor: Armand Ciavatta, 703 Birch Hill Dr., Bridgewater, N.J. 08807

[21] Appl. No.: 240,377

[22] Filed: Mar. 4, 1981

Related U.S. Application Data

[63] Continuation-in-part of Ser. No. 127,959, Mar. 7, 1980.

[51] Int. Cl.[3] ..... E21D 21/00; E21D 20/02

[52] U.S. Cl. ..... 405/261; 405/259; 405/260

[58] Field of Search ..... 405/259–262; 411/15, 16, 32, 33, 61–67

[56] References Cited

U.S. PATENT DOCUMENTS

| | | | |
|---|---|---|---|
| 2,753,750 | 7/1956 | Dempsey | 411/67 |
| 2,829,502 | 4/1958 | Dempsey | 405/261 |
| 2,930,199 | 3/1960 | Jarund | 405/260 |
| 3,283,513 | 11/1966 | Kierans | 405/260 |
| 3,653,217 | 4/1972 | Williams | 405/260 |
| 3,922,867 | 12/1975 | Scott | 405/259 |
| 4,012,913 | 3/1977 | Scott | 405/259 |
| 4,055,051 | 10/1977 | Finney | 405/261 |
| 4,126,004 | 11/1978 | Lindeboom | 405/259 |
| 4,260,294 | 4/1981 | Cantrel | 405/259 |

*Primary Examiner*—Dennis L. Taylor
*Attorney, Agent, or Firm*—Cushman, Darby & Cushman

[57] ABSTRACT

A mine roof support device comprising an elongated tubular shank having an oblate cross-section providing annularly spaced wall engaging peripheral portions for frictionally engaging the wall of a hole in the strata and annularly spaced non-wall engaging peripheral portions which are spaced radially from the wall of the hole, the exterior wall engaging surfaces of the wall engaging portions being configured such that frictional interengagement with the wall of the hold will result in a radially inward deflection of the wall engaging portions which deflection is accommodated by radially outward deflection of the non-wall engaging portions and a releasably contained charge of hardenable viscous grouting material operable to be applied between the wall of the hole and the exterior periphery of the shank as the latter moves upwardly into the hole while the material of the charge is viscous to thereby reduce by a lubricating action the frictional resistance occasioned by the engagement of the shank within the hole and so as to permit the material of the charge thus applied to harden after the shank has been moved into operative relation with the hole to thereby increase by a cementing action the frictional gripping action between the shank and the mine strata.

13 Claims, 17 Drawing Figures

FIG. 11
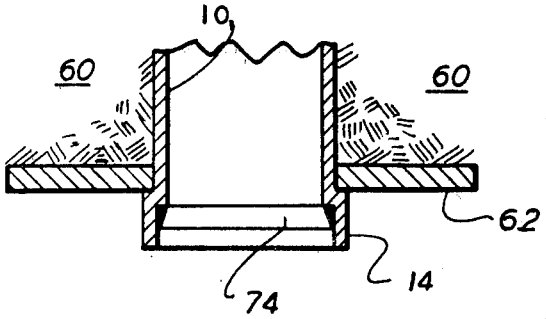
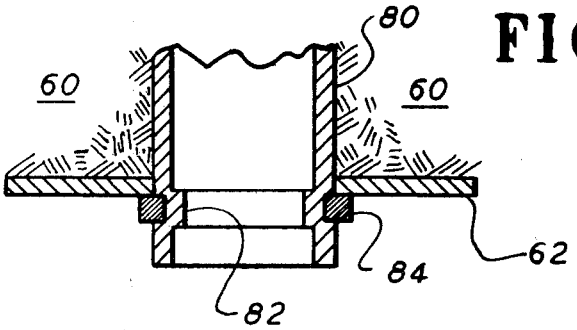
FIG. 12
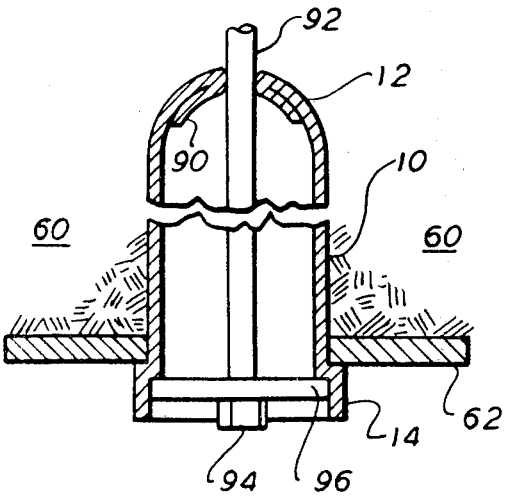
FIG. 13
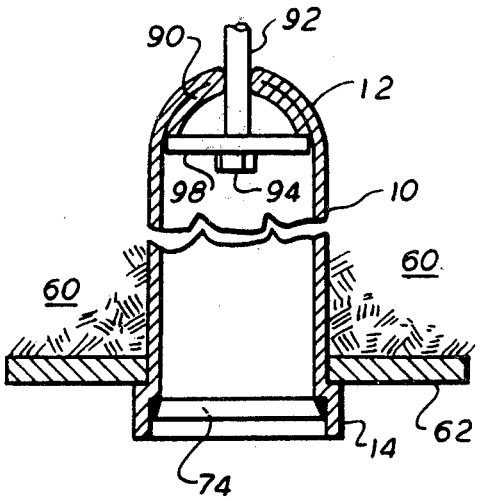
FIG. 14

FIG. 15
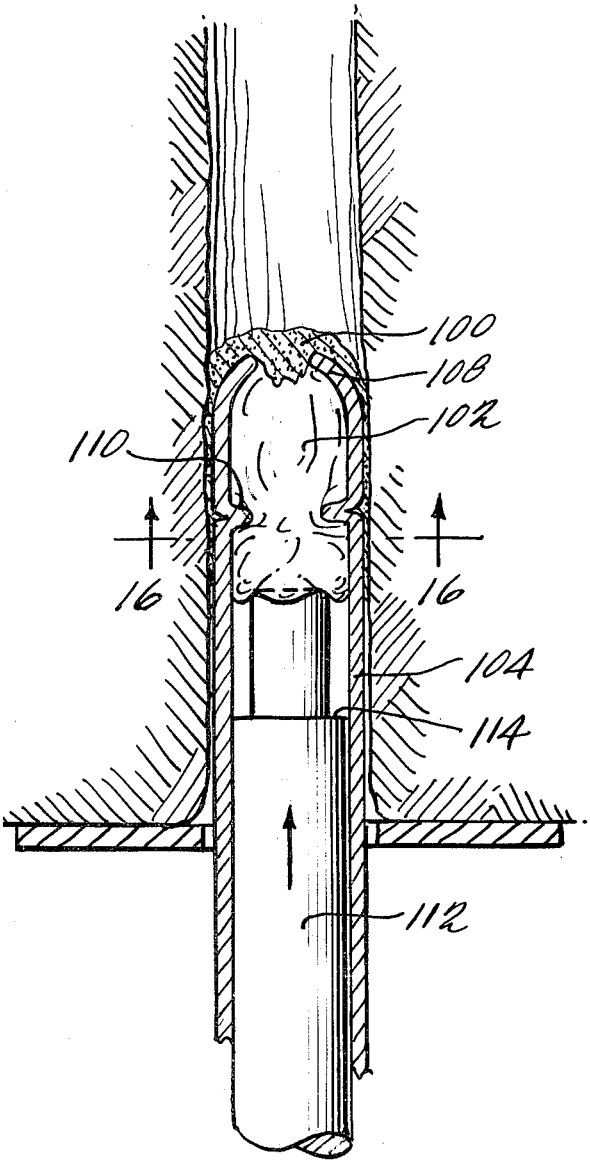
FIG. 17
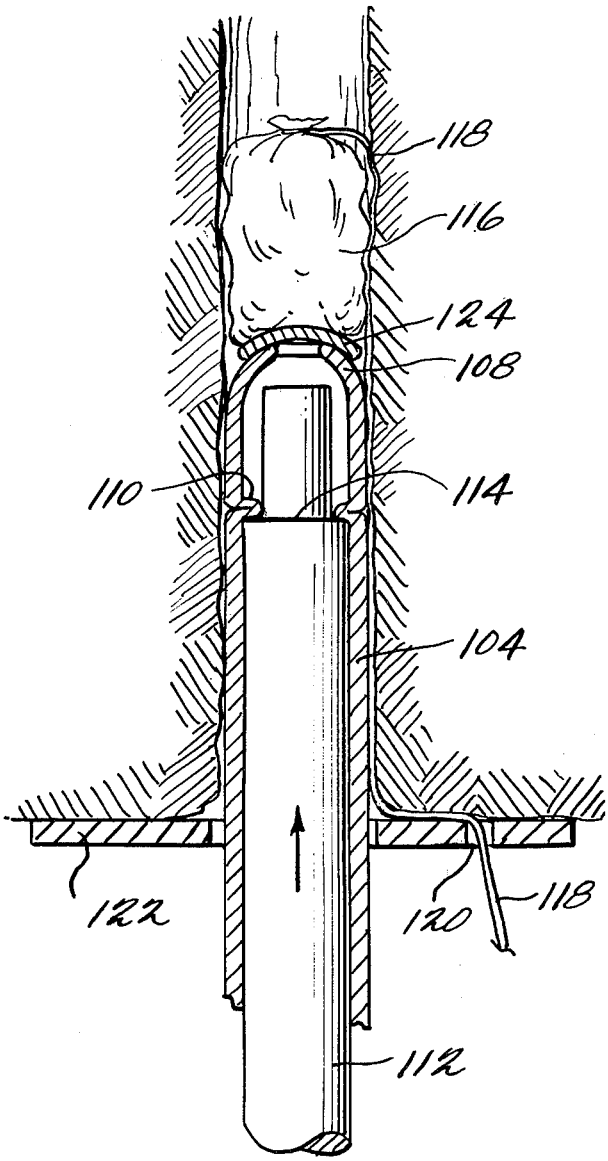
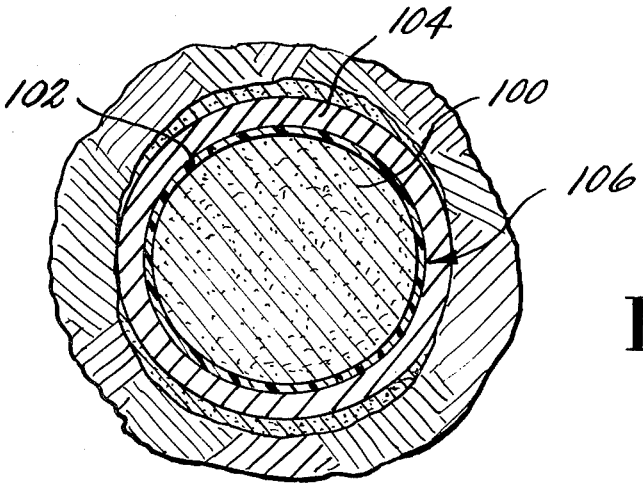
FIG. 16

FRICTION ROCK STABILIZER AND INSTALLATION LUBRICATING CEMENT APPARATUS AND METHOD

This application constitutes a continuation-in-part of my copending application Ser. No. 127,959 filed Mar. 7, 1980, entitled TUBULAR SHANK DEVICE.

This invention relates to devices for stabilizing or supporting mine roof strata and the like, and more particularly to improvements in mine roof supports of the friction stabilizer type.

Known devices suitable for stabilizing or supporting mine roof strata can be identified as belonging to one of three basic types: (1) mechanical roof bolts, (2) resin or cement grouted reinforcing bars or rebars, or (3) friction rock stabilizers. In all of these types of mine roof supporting devices the mine roof strata is first prepared by drilling a vertical hole therein. All of the various types of devices utilize a bearing plate for engaging the undersurface of the mine roof having an aperture extending therethrough in alignment with the hole. It will be understood that while such support devices are utilized primarily to support mine roof strata, they are equally applicable in other strata supporting situations as, for example, rib stabilization, slope stabilization, tunnel support, tie-backs and tie-downs.

The components of a mechanical mine roof bolt device include an elongated bolt and an expansion shell-nut assembly threadedly engaged on the threaded end of the bolt. The installation is completed by inserting the mine roof bolt assembly upwardly into the hole with the expansion shell-nut assembly in an unexpanded condition. When the bolt has been fully extended upwardly into the hole, the bolt is turned to cause the nut to expand the shell into radially outward engagement with the upper end portion of the wall of the hole. The bolt can then be suitably tensioned between the expanded anchoring shell and the bearing plate engaged by the head of the bolt. An example of a mechanical roof bolt in the patented literature is to be found in U.S. Pat. No. 2,753,750.

A grouted rebar device includes an components an elongated reinforcing bar and a suitable number of resin or cement cartridges, usually in sausage-shaped configuration. The installation of a grouted rebar device is accomplished by inserting the prescribed number of resin cartridges needed to fully grout the longitudinal extent of the reinforcing bar within the drilled hole. The reinforcing bar is then inserted upwardly into the hole, thereby rupturing the cartridges. In the event the resin is of the type which requires mixing the reinforcing bar may be turned to facilitate the mixing operation. Once the mixing operation is completed the grouting is allowed to set for the prescribed time, a minimum of which is usually 30 seconds. The resultant installation is completely passive in that the ability to hold the mine roof strata is dependent solely upon the cementing action between the wall of the hole and the exterior periphery of the reinforcing bar.

Efforts have been made to combine the holding actions achieved by mechanical roof bolt devices and grouted rebar devices. For example, U.S. Pat. No. 2,829,502 contains a grouting cartridge for use with a mechanical roof bolt in which the grouting material is confined within the upper end of the hole in surrounding relation with the expansion shell-nut assembly. In U.S. Pat. No. 3,653,217 there is provided a mechanical mine roof bolt in which grouting is provided within the annular space between the main portion of the roof bolt and the wall of the hole so that there is provided a cementing action throughout the longitudinal extent of the roof bolt in addition to the radially outward gripping action of the expansion shell-nut assembly.

Mechanical roof bolt devices and grouted rebar devices constitute almost the entire present commercial usage with mechanical roof bolts being used more widely than grouted rebars.

The third type of device is of relatively recent commercial usage. The present commercially offered friction rock stabilizer is disclosed in U.S. Pat. No. 4,126,004. The patent discloses improvements over earlier identified patent disclosures contained in U.S. Pat. Nos. 3,922,867 and 4,012,913. The rock stabilizers disclosed in the earlier patents are characterized in the later patent as comprising generally annular bodies which are longitudinally slit to that the same will yield under circumferential compression to accommodate a forced insertion thereof into an undersized bore. The improvement patent indicates that these fully slit stabilizers disclosed in the earlier patents have a tendency to fail when forceably inserted into a structure bore by a stabilizer driver, particularly if the stabilizer is not axially aligned with the bore hole and/or if the driver is also canted with respect to the driven end of the stabilizer, the slit provided to accommodate the reduction of the cross-sectional dimension of the stabilizer opens up and the stabilizer bends and becomes splayed. The essence of the invention of the improvement patent is to annularly rigidify the lower end of the split annular member. The result is that the tendency to fail noted with respect to the fully split stabilizers is alleviated.

These commercial friction rock stabilizers are advantageous in that they have an active holding engagement with the wall of the hole substantially throughout the longitudinal extent of the elongated split annular member. However, the efficiency of this gripping action bears a direct relationship with the difficulty encountered in inserting the split annular member upwardly into the hole. The more force required to insert the elongated split member into the hole, the greater the likelihood is the type of failure which is noted in the patent. The effect of the improvement of U.S. Pat. No. 4,126,004 in rigidifying the lower end of the split annular member is to provide the member with a variable resiliency which is greatest at the top and least at the bottom and progressively changes between the two. This means that the greatest resistance to insertion will be encountered toward the end of the insertion where the majority of the elongated split member is supported within the hole. Nevertheless, there is required considerable force to effect entry under the final insertion under these circumstances and the requirement to provide such excessive forces is hazardous in and of itself. There is a need for improvements in friction rock stabilizer devices which will provide the necessary rigidity to resist failure of the type described and reduce the excessive forces required to accomplish insertion while still maintaining an efficient gripping action with the wall of the hole.

In my aforesaid copending application Ser. No. 127,959 there is disclosed an improvement which will meet these needs by eliminating the provision of a split construction for the purpose of accommodating resilient deflection and utilizing instead an oblate cross-sectional configuration which provides annularly spaced wall engaging peripheral portions for frictionally engaging the wall of the hole and annularly spaced non-wall engaging peripheral portions which are spaced radially from the wall of the hole, the portions being integrally connected such that frictional interengagement with the wall of the hole will result in a radially inward deflection of the wall engaging portion, which deflection is accommodated by radially outward deflection of the non-wall engaging portions.

The present invention relates to improvements in friction rock stabilizer type roof support devices in which a hardenable viscous grouting material is utilized to both reduce the installation difficulties as well as enhance the support characteristics thereof after installation has taken place. Heretofore grouting material has either been applied after the installation of the support device, as when added to mechanical roof bolts, or prior to the installation as with grouted rebars. In either case, the grouting material has always served simply as a means for cementing or adhering the bolt or rebar within the drilled hole. Such cementing action has not been employed with existing split-C type friction bolt stabilizers, presumably because of the full exterior peripheral engagement of such stabilizers with the wall of the hole.

An important aspect of my aforesaid copending application is the discovery that a hardenable viscous grouting material can provide a highly advantageous function in the installation of a friction rock stabilizer type roof support, in addition to an enhancement of its support capability. As previously indicated, one of the problems inherent in known friction rock stabilizers is that the efficiency of the gripping action is a function of the energy expended in inserting the friction rock stabilizer in the roof strata. By utilizing grouting material, the relationship between the energy required to effect insertion and the holding action after insertion can be materially enhanced. Such enhancement is achieved in two ways. First, by providing grouting material in a viscous state between the wall of the hole and the exterior periphery of the elongated shank during the insertion of the elongated shank, the friction between the two which resists the insertion is materially reduced by the lubricating action of the viscous grouting material, thus reducing the force or energy requirements to effect insertion. After insertion, the viscous nature of the grouting material changes as the same hardens or cures so that the holding action normally provided by the frictional engagement of the exterior periphery of the shank with the wall of the hole is enhanced by the additional securement provided by virtue of the cementing action of the grouting material.

While this aspect of the present invention is applicable to any type of friction rock stabilizer, including the split-C type known in the prior art as identified above, this aspect of the present invention has particular advantages when utilized with the improved construction of the present invention.

In order to achieve the lubricating action it is necessary to apply the grouting material to the wall of the hole in its viscous state so that it will be in its viscous state when insertion takes place. This application of the grouting material to the wall of the hole can therefore best be undertaken by supplying freshly opened grouting material above the stabilizer within the hole as the insertion progresses. This application of the grouting material to the wall of the hole is facilitated by the oblate cross-section hollow shank structure of the present invention, by virtue of the fact that the oblate cross-sectional configuration of the shank structure provides spaced non-wall engaging portions inherently forming limited spaces within which to handle the viscous grouting material during installation. The provision of spaced wall engaging and non-wall engaging portions on the exterior periphery of the shank structure of the present invention permits the grouting material which has already been applied between the wall of the hole and the exterior periphery of the shank structure to be displaced as insertion progresses to thereby repeatedly renew the lubricating action as insertion takes place, as for example, by turning the straight oval cross-section shank structure or by inserting the spiral oblate shank structure rectilinearly. Such a repeated renewing of the lubricating action achieves a much more significant reduction in the insertion friction force than would be the case where continuous full peripheral surface frictional engagement is maintained. Viewed in terms of the final installation, it can be seen that with the present construction, the wall engaging peripheral portions of the shank structure will provide substantially the same significant frictional gripping action while the non-wall engaging portions which heretofore did not actively enter into the frictional holding action now can provide passive holding action by virtue of the cementing action of the grouting material once hardened. The action is significantly different from that provided by a grouted rebar support device not only in the additive dual holding actions provided, but in the significant reduction in the amount of grouting material utilized to achieve the cementing action, as for example, a ratio of approximately 1:8. That is, the filling of the radial space between the non-wall engaging portions of the present shank structure and the wall of the hole takes about $\frac{1}{8}$ the amount of grouting material as that required to fill the full annular space surrounding the non-contacting exterior periphery of a rebar and the interior wall of the hole.

These and other objects of the present invention will become more apparent during the course of the following detailed description and appended claims.

The invention may best be understood with reference to the accompanying drawings, wherein as illustrative embodiment is shown.

In the drawings:

FIG. 11 is a detailed sectional view of an aft end which is alternate to that of FIG. 9;

FIG. 12 is a detailed sectional view of an aft end which is alternate to that of FIG. 9;

FIG. 13 is a sectional view of the shank of FIG. 1, shown installed together with a known roof bolt;

FIG. 14 is a sectional view of the shank of FIG. 11, shown installed with a known roof bolt;

FIG. 15 is a vertical sectional view of a shank similar to the shank shown in FIG. 1 having the grouting material improvements of the present invention embodied therewith, the shank being shown in the initial stages of insertion within a vertical hole drilled within the strata of a mine roof;

FIG. 16 is an enlarged fragmentary sectional view taken along the line 16—16 of FIG. 15; and FIG. 17 is a view similar to FIG. 15 of another form of the grouting material improvement embodying the principles of the present invention.

Figure 1:
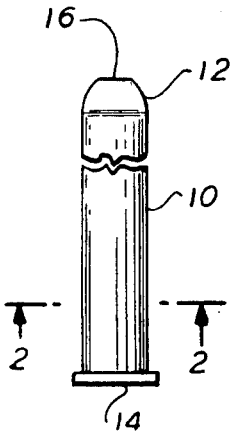
FIG. 1 is a side view of a tubular shank according to the present invention.
Figure 2:
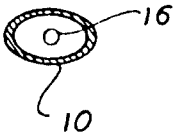
FIG. 2 is a sectional view along the lines 2—2 of FIG. 1.

Referring to FIGS. 1 and 2, a shank structure in the form of a tubular shank 10 is shown having the oblate cross-section illustrated in FIG. 2. The cross-section of FIG. 2 is essentially elliptical although it is anticipated that oval, polygonal, convex and other shapes may be employed instead. It is preferred that the perimeter of the cross-section of FIG. 2 be convex to facilitate installation. If the shank was formed of overlapped sheet metal it would have a ridge that would make it partly concave. Shank 10 has blunted, hemispherically domed, forward end 12 and a flared aft end 14. End 12 has an open mouth 16. It will be appreciated that various tapered and flared shapes may be employed for ends 14 and 16. Although shank 10 is for the most part a uniform elliptic cylinder, in some embodiments the shank will converge slightly toward the rear. This feature raises initial insertion force but moderates final insertion force. Alternatively, shank 10 can be an elliptic cylinder that converges slightly toward the front. This latter feature provides greater gripping action near the surface where the strata may tend to shift.

For those embodiments wherein shank 10 is to be stably mounted in underground strata, the shank should be more than one foot long to perform this task. For example, in some embodiments the overall length of the tubular shank will be about 5 feet. In addition, for this embodiment the tubular shank had an elliptical cross-section with a major diameter of 1.38 inches and a minor diameter of 1.12 inches. The shank was formed of steel having a wall thickness of 0.075 inch. It is to be appreciated that alternate thicknesses, lengths and diameters can be employed instead of the foregoing depending upon the particular application for which the device is intended. This foregoing embodiment was designed to be driven into a 1.280 inch bore hole. It is to be noted that this is an interference fit so that shank 10 must be compressed by reducing its major diameter and expanding its minor diameter. Accordingly, the cross-section of shank 10 becomes formed more like a circle. It is preferred that the walls of shank 10 will be designed to cause inelastic yielding when shank 10 is driven into its bore. For embodiments (described hereinafter) wherein the shank has a reduced diameter section, that section may be stressed less and experience elastic deformation only.

Figure 3:
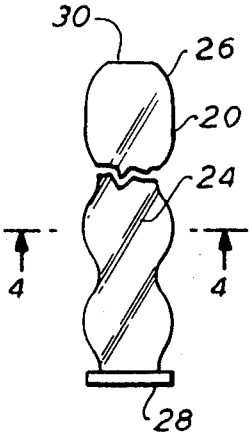
FIG. 3 is a side view of an alternate tubular shank according to the present invention.
Figure 4:
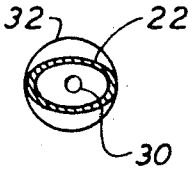
FIG. 4 is a sectional view along the lines 4—4 of FIG. 3.

Referring to FIGS. 3 and 4, an alternate shank 20 is illustrated which has the elliptical cross-section 22 shown in FIG. 4. The outer surface shown in FIG. 3 is formed essentially by uniformly rotating an ellipse as it progresses down the longitudinal axis of shank 20. The shape thus formed is deemed to have spiral ribs, as suggested by the spiral lines such as line 24. Shank 20 again has a tapered, hemispherical forward end 26 and a flared end 28. The domed end 26 is open at mouth 30. Referring to FIG. 4, it is to be appreciated that the elliptical cross-section 22 is shown surrounded by a circular area 32 since this area is formed by the rotation of the ellipse beyond cross-section 22.

Figure 5:
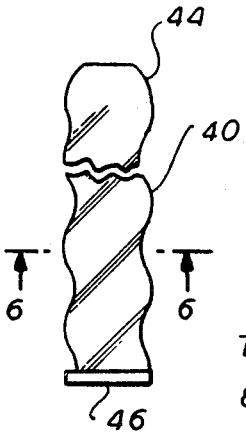
FIG. 5 is a side view of an alternate tubular shank according to the present invention.
Figure 6:
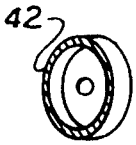
FIG. 6 is a sectional view along the lines 6—6 of FIG. 5.

Referring to FIGS. 5 and 6, an alternate shank 40 is illustrated which has elliptical cross-section 42. The shank 40 has a constant elliptical cross-section but which shifts transversely along the longitudinal axis of the shank. This shifting, however, is in one direction only. In this embodiment the shifting is parallel to the minor axis of elliptical cross-section 42. Thus, it is appreciated that the side view of shank 40, if rotated 90° about its longitudinal axis, will appear identical to the shank of FIG. 1. Shank 40, again has a domed forward end 44 and a flared outer end 46.

Figure 7:
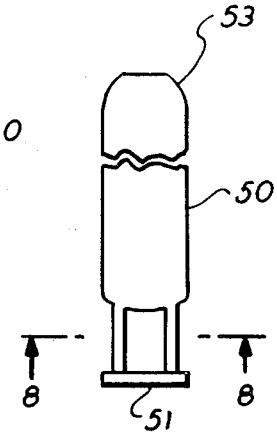
FIG. 7 is a side view of an alternate tubular shank according to the present invention.
Figure 8:
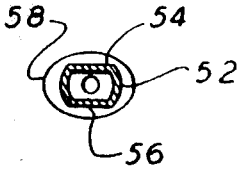
FIG. 8 is a sectional view along the lines 8—8 of FIG. 7.

Referring to FIGS. 7 and 8, a tubular shank 50 is shown which has a domed forward end 53 and, at its mid-point, an elliptical cross-section which is identical to that illustrated in FIG. 2. The portion at lines 8—8 is referred to herein as an aft cylindrical portion adjacent a central portion. Essentially, lower cross-section 52 is circular except for flattened opposing surfaces 54 and 56. It is to be appreciated that in some embodiments these flattened surfaces will be deleted or the number of flattened surfaces will be increased to provide a hexagonal or other polygonal shape. It is important to note that the outer perimeter of lower cross-section 52 is smaller than the perimeter of the central portion 58 of shank 50. This feature allows the shank to be easily inserted into a bore, since the frictional forces due to circular cross-section 52 are relatively small. Consequently, the force required to drive the last foot or so of shank 50 will not significantly increase. Thus the tendency for flared end 51 to bend or crush is reduced.

Figure 9:
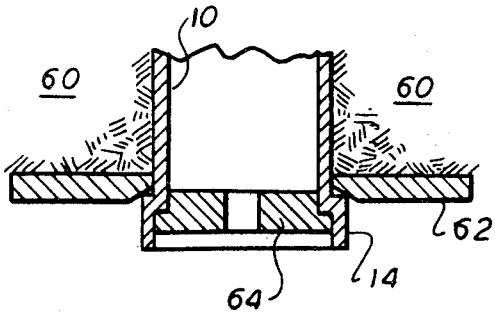
FIG. 9 is a detailed sectional view of the aft end of the tubular shank of FIG. 1 showing it installed.

Referring to FIG. 9, a detailed, transverse sectional view of the aft end of the shank of FIG. 1 is given. Shank 10 has flared end 14 which is essentially a cylindrical butt of increased diameter. Shank 10 is shown embedded in a circular bore in strata 60. An apertured plate 62 is shown encircling shank 10 forward of flared end 14.

Annulus 64, used in this embodiment, is an apertured cylindrical disc coaxially fitted within the flared end 14 of shank 10. Annulus 64 provides a surface for applying a driving force to seat shank 10 into strate 60. In addition, by spanning the inner sidewalls of flared end 14, annulus 64 provides reinforcement which prevents bending or crushing of flared end 14.

For those embodiments in which the portion of shank 10 adjacent end 14 is an elliptic cylinder, it is preferred to have an elliptical aperture in plate 62. However, it is anticipated that for many embodiments a circular aperture will be employed instead. This aperture will have an inside diameter matching the major diameter of the elliptic cylinder.

The shank of FIG. 9 is readily installed by aligning its forward domed end and the aperture in plate 62 with the bore in strata 60. Thereafter a pneumatic hammer or similar device is applied against pusher disc 64, thereby driving shank 10 into strata 60 until it is in the position illustrated in FIG. 9. It is to be appreciated that the bore in strata 60 is smaller than the unstressed major diameter of shank 10. Accordingly, shank 10 is compressed along its entire length and is thus firmly held within strata 60. This frictional feature is important where the strata may shift due to blasting or natural shifting. Under such conditions shank 10 may bend or be severely deformed. However, it will not tend to loosen since it applies frictional force along its entire length.

Figure 10:
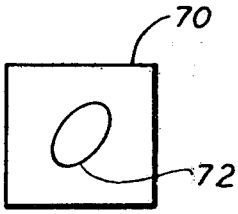
FIG. 10 is a plan view of a member used in installing the shank of FIG. 1.

It is anticipated that in some instances the elliptical shape previously described will be formed at the installation site. This shaping can be performed with a die member such as the plate shown in FIG. 10. Die member 70 has elliptical aperture 72. Accordingly, a cylindrical tube can be forced through member 70, thereby deforming the tube. Thus deformed, the tube acts similar to the shanks previously described.

Referring to FIG. 11, an alternate device is illustrated which is identical to the apparatus of FIG. 9 except that weld bead 74 is included instead of an internal pusher disc. Bead 74 is inserted at the inside corner formed by the outwardly diverging and rearwardly directed portion of flared end 14. The bead 74 acts like a brace to transfer shear forces inwardly so they act centrally along the walls of shank 10, thus increasing the size of the shear plane. Also bead 74 reinforces flared end 14 so that it maintains its shape and does not crush or allow plate 62 to slip by.

Referring to FIG. 12, an alternate tubular shank 80 is illustrated. Shank 80 is shaped the same as the shank of FIG. 1 except that annular crimp 82 is provided instead of a flared end. Fitted into crimp 82 is retaining ring 84 which holds plate 62 in place against strata 60. Crimp 82 has a depth that preferably equals half of the wall thickness of shank 80, although this depth is not exclusive. The area of the shear plane within the device of FIG. 12 will be greatest when the floor of crimp 82 falls somewhere between the inside and outside diameter of shank 10.

Referring to FIG. 13, the shank 10 of FIG. 1 is shown installed in a bore in strata 60. As before, a roof plate 62 is pressed against strata 60 by the flared end 14 of shank 10. In this embodiment domed end 12 has inwardly bent tab 90, although other embodiments will not include such a tab.

Mounted coaxially within shank 10 is a conventional roof bolt 92 which extends beyond domed end 12. Bolt 92 has a conventional anchor (not shown) at its forward end. The aft end of bolt 92 is formed into bolt head 94. Bolt head 94 presses retaining member 96 into flared end 14 of shank 10. Retaining member 96 is shaped as a large flange in this embodiment.

The equipment of FIG. 13 is installed by inserting bolt 92 into shank 10 with the anchor (not shown) on the tip of bolt 92 and retaining member 96 on bolt 92 between head 94 and flared end 14. The combination of FIG. 13 is inserted into the bore of strata 60. It is driven in by applying an air hammer or other suitable tool to retaining member 96. Once roof plate 62 is held firmly against strata 60, bolt head 94 is rotated to plant its anchor and put bolt 92 into tension.

Thus assembled, plate 62 is held in by two mechanisms: the frictional force of shank 10 and the anchoring force of bolt 92. These two mechanisms produce orthogonal compressive forces. Shank 10 produces transverse compression against the strata and bolt 92 longitudinal compression. An advantage of the foregoing combination is that the effective length of the combination can be significantly increased without a corresponding increase in the driving force needed to seat shank 10.

It is also anticipated that for some embodiments the equipment of FIG. 13 will be appropriately apertured to allow injection of a well-known resin or cement which surrounds and secures bolt 92 within its bore.

Referring to FIG. 14, an installation similar to FIG. 13 is shown, except bolt head 94 holds retaining member 98 against tab 90 in the domed end 12 of shank 10. This particular embodiment employs the reinforcing weld bead previously described in FIG. 11. The equipment of FIG. 14 is installed similarly to that of FIG. 13. However, it is convenient to apply alternatively a driving hammer against flared end 14 (FIG. 14) and retaining member 98. Thereafter bolt 92 can be put into tension and its anchor set by rotating bolt head 94 with an appropriate tool.

It is to be appreciated that various modifications may be implemented with respect to the above described preferred embodiments. For example, various dimensions can be altered to accommodate different applications. In addition, alternate materials may be substituted to provide the desired strength, weight, holding capacity, etc. In addition, the surfaces may be roughened or corrugated to provide additional frictional forces. Furthermore, the shank cross-sections may be elliptical, oval, polygonal or other oblate shapes. In addition, it is anticipated that for some embodiments the surface of the flared end may be flattened into a hexagonal prism so that it can be used as a bolt head to drive and twist the shank into its bore. Also, in embodiments including an anchoring device, such as shown in FIG. 14, the shank may have various cross-sections including circular.

FIGS. 15–17 illustrate the combination of the shank structure with grouting material and the procedures for utilizing the grouting material with the shank structure in accordance with the method aspects of the present invention. The present method contemplates the utilization of any of the well-known grouting materials which can be supplied and applied in a viscous state and which are hardenable to provide a cementing action between the wall of the hole and an elongated shank structure. Thus, an exemplary grouting material utilized herein is the polyester resin manufactured and sold by duPont under the trademark FASLOC® as a component of the typical grouted rebar installation. The FASLOC resin, when used in a rebar installation, is mixed in situ with a catalyst for the purpose of achieving fast setting. Fast setting is required in a rebar installation because the rebar does not have any other means of securement within the hole and therefore must be extraneously retained therein as a step in the installation until a certain amount of setting has taken place. This installation time may be regarded as a disadvantage of the rebar device. In view of the frictional securement of the shank structure of the present invention within the hole upon installation it becomes possible to use catalysts which are not quick setting. Moreover it is possible to utilize resins or other grouting materials which provide the most desirable lubricating characterists during installation without regard to the rapidity with which the resin or grouting material is cured or hardened. The FASLOC resin and catalyst is regarded as an exemplary grouting material for use in the present method because of its proven success as a cement for rebars.

In carrying out the method of the present invention there is used a charge of hardenable viscous grouting material, such as FASLOC resin, indicated by the reference numeral 100 in FIG. 15, of an amount sufficient to cover the wall of the hole within which the shank structure is to be inserted and to fill the void spaces between the non-wall engaging portions of the shank structure and the wall of the hole. The charge of a hardenable grouting material 100 is contained in a viscous state within a releasable container, indicated by the reference numeral 102 in FIG. 15. As shown, the container is in the form of a bag made of plastic film, as for example, MYLAR®. The charge of hardenable viscous grouting material contained within the container 102 includes both a resin component and a catalyst component separated by a burstable membrane in accordance with the standard FASLOC practice. The mixing of the components can be accomplished in several different ways. For example, the mixing can be accomplished by a manual kneading action of the flexible container, in accordance with known technology.

In the embodiment shown in FIG. 15, the container 102 with the viscous hardenable grouting material 100 contained therein, mixed as aforesaid, is positioned within the leading end of a shank structure 104 which may be constructed in accordance with any of the embodiments previously described. As shown, the shank structure 104 is of oval oblate cross-sectional construction and is formed by bending a strip of sheet metal into the desired oblate oval cross-sectional configuration with the seam provided with a continuous weld, as indicated at 106. It will be understood that while a continuous seam weld 106 is preferable, it is within the contemplation of the present invention to provide spot welding in lieu of a continuous weld. As shown in FIG. 16, the welded joint is provided at a position aligned with the major axis of the oblate cross-sectional configuration. While this position is preferable it will be understood that the seam may be provided at other positions as, for example, along the minor axis or desired positions between the major and minor axes.

It will also be understood that the shank structure can be formed of materials other than sheet steel, as, for example, a fiberglass reinforced resin molding, pultrusion or the like.

In the embodiment shown in FIGS. 15 and 16, the leading or upper end of the shank structure 104 is formed with an open domed configuration, as indicated at 108, and there is provided at a position spaced below the open domed end an interior annular flange 110. The flange 110 provides a striking surface for a driver 112 which enables the impact forces necessary to accomplish insertion to be applied to the leading end of the shank structure 104 rather than the trailing end thereof, so that the installation force application is transmitted to the wall engaging portions of the shank structure in tension rather than in compression, as would be the case where the impact blows are delivered to the lower end of the shank structure.

It will be noted that the driver 112, as shown, is provided with a shoulder 114 adjacent its upper end. The upper end portion of the driver 112 which is of reduced cross-sectional dimension, serves to engage the container 102, within the upper end 108 of the shank structure 104, causing the container 102 to burst or fracture as the insertion of the shank structure 104 within the hole commences. The grouting material 100 thus released is forced upwardly through the open dome 108 and outwardly into the hole where it flows downwardly over the exterior of the dome onto the wall of the hole. As the insertion of the shank structure 104 proceeds by the driver the viscous grouting material is therefore applied to the wall of the drilled hole. With the utilization of a shank structure 104 having a uniform oblate cross-section throughout (i.e. one which does not spiral or the like), it is desirable that the shank structure be turned in the hole during the upward inserting movement thereof, since such turning movement has the effect of changing the angular positions in the wall of the hole which are engaged by the spaced wall engaging portions and spaced from the non-wall engaging portions of the periphery of the shank structure. In this way, there is a progressive movement of viscous grouting material from the annular positions where grouting material is relatively thick by virtue of the spacing of the non-wall engaging peripheral portions onto those portions of the wall where engagement or frictional contact is taking place. The lubricating effect of the grouting material thus materially aids in facilitating the vertical movement of the shank structure upwardly into the hole.

Once the shank structure 104 is fully inserted within the hole the wall engaging portions on the periphery of the shank structure which frictionally contact the wall of the hole provide essentially the same measure of securement which they would provide in the absence of the grouting material. In addition, it will be noted that the non-wall engaging portions of the shank structure which, without the provision of the grouting material, are passive insofar as securement function is concerned, now enter into the securement by virtue of the cementing action of the grouting material once hardening has taken place after full installation is accomplished. Thus, it can be seen that with the utilization of the grouting material in the manner described above, the energy requirements to effect installation of the shank structure within the drilled hole are reduced while at the same time the cementing action of the grouting material greatly enhances the overall securement of the installation. Moreover, these advantages are achieved by the utilization of an amount of grouting material which is approximately $\frac{1}{8}$ the amount required in a comparable conventional grouted rebar installation.

While the above installation has been described in connection with the pre-mixing of the hardenable viscous grouting material components prior to installation within the upper end of the shank structure, it will be understood that such mixing may take place after the container has been placed within the shank structure by providing for a mixing or swirling movement of the components as they are pushed outwardly through the upper opening, as by fluted ribs or the like. In this way, mixing is accomplished by the movement of the grouting material outwardly through the upper end of the shank structure into the hole.

It will be noted that the annular flange 110 is positioned to engage the periphery of the container 102 intermediate the ends thereof. It is within the contemplation of the present invention to position the annular flange 112 entirely below the container and for purposes of preventing the grouting material from contacting the driver to provide a piston-like container bursting disc below the container which engages the inner periphery of the shank structure and is moved upwardly by engagement with the end of the driver.

FIG. 17 illustrates another procedure for accomplishing the positioning of the hardenable viscous grouting material within the lower end of the hole preparatory to the insertion of the shank structure 104 therein. In this embodiment there is provided a separate container 116 which contains the hardenable viscous grouting material. The container is provided with a releasing strip 118. As before, the container 116 is in the form of a bag made of plastic film and preferably the contents thereof, which includes resin and catalyst, are originally contained therein separated by a burstable membrane so that manual mixing by a kneading action can be accomplished within the container 116 before insertion within the drilled hole. It will be noted from FIG. 17 that when the container 116 is engaged within the lower end of the hole, the releasing strip 118 is allowed to extend downwardly and through an opening 120 formed in the bearing plate 122 which engages the lower surface of the mine roof strata. Since the grouting material is extraneous of the shank structure it is preferable to provide a cap member 124 on the upper exterior of the shank member to cover the open dome configuration 108. It will be noted that when the shank structure is engaged upwardly into the hole the container 116 will be engaged by the cap 124 as the shank structure is moved upwardly. Since the releasing grip 118 is retained against upward movement the container will be moved upwardly separating from the releasing strip and releasing the hardenable viscous grouting material into the hole above the upper end of the shank structure. In this way, as the upward movement of the shank structure proceeds, the grouting material will be applied to the wall of the hole and the same lubricating action during installation will be provided and the same cementing action after installation will be provided.

It will be understood that the principles of the present invention relating to the grouting method wherein the hardenable viscous grouting material is applied to the wall of the hole so as to provide a lubricating action for the insertion of a friction rock stabilizer type roof support device and a subsequent cementing action for such device, is applicable to any type of friction rock stabilizer type of roof support device, including the known split annular member device disclosed in the aforesaid patents. These grouting principles, however, are particularly effective with the oblate non-split shank configuration embodied in the present friction rock stabilizer because of the provision of the spaced wall engaging and non-wall engaging portions on the exterior periphery of the shank structure as compared with the full peripheral contact of the prior art split type shank construction. As indicated, the non-wall engaging portions receive grouting material during installation and where a turning action is applied to a straight oval cross-sectional shank structure or a rectilinear upward movement is applied to a spiral oval cross-section, the grouting material captured in the non-wall engaging spaces can be utilizied as a means to apply lubrication to surfaces which are to be immediately brought into contact. Moreover, after the installation has been accomplished the non-wall engaging portions which are passive insofar as friction engagement is concerned, enter into a cementing engagement which is additive to the friction engagement.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. In a device for supporting mine roof strata comprising an elongated shank structure having an exterior periphery for frictionally engaging a wall of a drilled hole in the mine roof strata at least at annularly spaced portions substantially throughout the vertical extent of the shank structure when operatively engaged within the hole, the improvement in combination therewith which comprises a charge of hardenable viscous material of a quantity sufficient to extend between the wall of the hole and the exterior periphery of said shank structure generally throughout the vertical extent of the shank structure when operatively engaged therewith, and means for (1) containing therein said charge of viscous material in a viscous state so as to enable said charge to be initially positioned adjacent the lower end of the hole and (2) releasing therefrom said charge when so initially positioned so as to enable the upward movement of said shank structure in said hole to apply the released charge between the wall of the hole and the exterior periphery of the shank structure as the latter moves upwardly into the hole while the material of the charge is viscous to thereby reduce by a lubricating action the frictional resistance occasioned by the engagement of the shank structure within the hole and so as to permit the material of the charge thus applied to harden after the shank structure has been moved into operative relation with the hole to thereby increase by a cementing action the frictional gripping action between the shank structure and the mine strata.

2. A device as defined in claim 1 wherein said shank structure comprises:

a tubular shank having an oblate cross-section, said shank having a length sufficient to stabilize it from loosening in said underground strata, whereby said shank is forwardly drivable into a hole that is sized to transversely compress said shank, said oblate cross-section providing annularly spaced wall engaging peripheral portions for frictionally engaging the wall of the hole and annularly spaced non-wall engaging peripheral portions which are spaced radially from the wall of the hole, said portions being integrally interconnected in annular force translating relation throughout a substantial portion of the length of the tubular shank such that frictional interengagement with the wall of the hole will result in a radially inward deflection of said wall engaging portions which deflection is accommodated by radially outward deflection of said non-wall engaging portions.

3. A device according to claim 1 wherein said shank comprises an elliptic cylinder having a tapered forward end.

4. A device according to claim 1 wherein said tapered forward end is domed.

5. A device according to claim 1 wherein said shank has a spiral rib.

6. A device according to claim 1 wherein said shank is undulated in a given transverse direction, said transverse direction being parallel to the chord of said oblate cross-section which defines its minimum thickness.

7. A device according to claim 2 wherein said shank has a flared aft end.

8. A device according to claim 1 wherein said shank has a smaller aft section adjacent an end of the shank, said aft section being sized to cause less friction than section having said oblate cross-section, whereby the force required to fully drive said shank into said hole is reduced due to said aft section.

9. A device according to claim 7 further including an annulus coaxially mounted in the flared end of said shank, said annulus having an inside diameter smaller than that of said shank, said annulus being sized to reinforce and provide a ramming surface for said shank.

10. A device according to claim 7 wherein said shank has at least one flat surface sized to allow gripping and twisting thereof by a tool.

11. A device according to claim 7 wherein said flared end has an outwardly diverging section followed by a rearwardly directed section, said flared end including on its inside surface a weld bead at the intersection of said diverging and said rearwardly directed section.

12. A device according to claim 1 wherein said shank has an annular crimp near its aft end, said device further comprising a retaining ring mounted in and extending outwardly from said crimp, said crimp having a depth less than the wall thickness of said tubular shank.

13. A grouting assembly for use with an elongated shank structure having an exterior periphery for frictionally engaging a wall of a drilled hole in the mine roof strata at least at annularly spaced portions substantially throughout the vertical extent of the shank structure when operatively engaged within the hole, said grouting assembly comprising a charge of hardenable viscous material of a quantity sufficient to extend between the wall of the hole and the exterior periphery of the shank structure generally throughout the vertical extent of the shank structure when operatively engaged therewith, and container means containing said charge of viscous material in a viscous state having means for initially positioning the same with said charge therein in a viscous state within the lower end of the hole and means enabling the release therefrom of said charge when so initially positioned so as to enable the upward movement of the shank structure into the hole to apply the released charge between the wall of the hole and the exterior periphery of the shank structure as the latter moves upwardly into the hole while the material of the charge is viscous to thereby reduce by a lubricating action the frictional resistance occasioned by the shank structure within the hole and so as to permit the material of the charge thus applied to harden after the shank structure has been moved into operative relation with the hole to thereby increase by a cementing action the frictional gripping action between the shank structure and the mine strata.

* * * * *